US006172656B1

(12) United States Patent
Ohwada et al.

(10) Patent No.: US 6,172,656 B1
(45) Date of Patent: Jan. 9, 2001

(54) ANTENNA DEVICE

(75) Inventors: Tetsu Ohwada; Moriyasu Miyazaki; Tsutomu Endo, all of Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/407,965

(22) Filed: Sep. 29, 1999

(30) Foreign Application Priority Data

Jun. 29, 1999 (WO) ..... PCT/JP99/3453

(51) Int. Cl.[7] ..... H01Q 1/36

(52) U.S. Cl. ..... 343/895; 343/700 MS; 343/767; 343/770

(58) Field of Search ..... 343/895, 700 MS File, 343/853, 767, 770; 333/24 C

(56) References Cited

U.S. PATENT DOCUMENTS

| | | | | |
|---|---|---|---|---|
| 3,696,433 | * | 10/1972 | Killion et al. | 343/771 |
| 5,134,422 | * | 7/1992 | Auriol | 343/895 |
| 5,784,034 | | 7/1998 | Konishi et al. | 343/895 |
| 5,798,734 | | 8/1998 | Ohtsuka et al. | 343/700 MS |
| 5,828,348 | * | 10/1998 | Tassoudji et al. | 343/895 |
| 5,917,454 | * | 6/1999 | Hill et al. | 343/769 |
| 5,955,997 | * | 9/1999 | Ho et al. | 343/767 |
| 5,986,616 | * | 11/1999 | Edvardsson | 343/853 |
| 6,075,501 | * | 6/2000 | Kuramoto et al. | 343/895 |

FOREIGN PATENT DOCUMENTS

| | | |
|---|---|---|
| 63-30006 | 2/1988 | (JP) . |
| 951224 | 2/1997 | (JP) . |
| 9307326 | 11/1997 | (JP) . |
| 12568240 | 9/1998 | (JP) . |

OTHER PUBLICATIONS

Kilgus, C.C., "Resonant Quadrifilar Helix Design", Applied Physics Laboratory of Johns Hopkins Univ., Silver Spring, MD, The Microwave Journal, Dec. 1970, pp. 49–54.

* cited by examiner

*Primary Examiner*—Don Wong
*Assistant Examiner*—Tuyet T. Vo
(74) *Attorney, Agent, or Firm*—Rothwell, Figg, Ernst, & Manbeck

(57) ABSTRACT

The present invention aims at supplying an electric current to a helical antenna in a non-contacting manner.

A dielectric tube is provided on an outer surface thereof with a feeding input terminal, strip conductors and hybrid ICs. The dielectric tube is provided on an inner surface thereof with a base conductor and slots.

A helical antenna is inserted into the portion of an inner space of the dielectric tube which is opposed to the slots. The strip conductors cross the slots via the wall of the dielectric tube. The slots are connected electromagnetically to the helical antenna radiation elements in a non-contacting manner. The slots are connected electromagnetically to the strip conductors. A microwave drives the helical antenna radiation elements via the input terminal, hybrid ICs strip conductors and slots.

12 Claims, 12 Drawing Sheets

ANTENNA DEVICE

BACKGROUND OF THE INVENTION

1. Field of the Invention

This invention relates to a means for supplying an electric current to a helical antenna in a non-contacting manner, and more particularly to a two-wire or four-wire wound helical antenna.

2. Description of the Related Art

The conventional antenna devices of this kind include, for example, the ¼ turn volute with split sheath balun of FIG. 6 for a "Resonant Quadrifilar Helix Antenna" reported on the Microwave Journal, December, 1970, p49–53, and the antenna device disclosed in Japanese Patent Laid-Open No. 30006/1988. FIG. 13 is a sketch drawing of the ¼ turn volute with split sheath balun reported on the Microwave Journal. 101 denotes a first helical antenna radiation element pair, 102 a second helical antenna radiation element pair, 103 a coaxial feeder cable, 104 a ¼ wavelength slit cut in an outer conductor of the coaxial cable 29, 105 an impedance conversion member provided on an inner conductor of the coaxial cable 103, and 106 a feeding point of the first and second helical antenna radiation element pairs 101, 102.

Both of the first and second helical antenna radiation element pairs 101, 102 can be regarded as balanced lines just as parallel two-wire lines in view of the operating condition thereof. Therefore, when an electric current is supplied to the antenna by connecting an unbalanced line, such as the coaxial cable 103 thereto, it is necessary to provide a balance-unbalance converter between the helical antenna radiation element pairs and coaxial cable. To meet this requirement, a balun comprising the coaxial cable 103, ¼ wavelength slit 104 and impedance conversion member 105 is provided.

The conventional antenna device shown in FIG. 13 is formed as described above, in which the first and second helical antenna radiation element pairs 101, 102 are connected directly to the inner conductor of the coaxial feeder cable 103. Therefore, in order to move the helical antenna radiation element pairs 101, 102 as movable parts, the coaxial cable has to be moved simultaneously. This makes it difficult to move the helical antenna radiation element pairs, and, when the radiation element pairs are moved repeatedly, they are broken easily.

Since the antenna of a portable telephone has to be inserted and withdrawn easily, it is difficult to use the antenna of FIG. 13 for this purpose.

SUMMARY OF THE INVENTION

An object of the present invention is to move a helical antenna easily by supplying an electric current thereto in a non-contacting manner.

The present invention relates to an antenna device provided with the following structures (a)–(d):

(a) a dielectric tube, (b) a conductor provided on an inner surface of the dielectric tube and having slots, (c) strip conductors provided on an outer surface of the dielectric tube and crossing the slots, and (d) helical antenna radiation elements inserted in the portion of an inner space of the dielectric tube which is opposed to the slots, and adapted to be driven by the slots and strip conductors.

Since the helical antenna radiation elements and slots are connected electromagnetically in a non-contacting manner with the slots connected electromagnetically to the strip conductors, an electric current can be supplied to the helical antenna in a non-contacting manner.

This enables the movements of the helical antenna to be made easily.

The antenna device according to the present invention is preferably provided with the following structures (a)–(e):

(a) a dielectric tube, (b) a conductor provided on an inner surface of the dielectric tube and having at least two slots, (c) at least two strip conductors provided on an outer surface of the dielectric tube and crossing the slots, (d) a phase difference distributing circuit adapted to give a 180° phase difference between electromagnetic waves propagated through the strip conductors, and (e) at least two helical antenna radiation elements which are provided on symmetrical portions of a column inserted in the portion of an inner space of the dielectric tube which is opposed to the slots, and which are adapted to be driven by the slots and strip conductors at a 180° phase difference.

Since an electric current can be supplied to the helical antenna in a non-contacting manner, the antenna can be moved easily.

Since the two helical antenna radiation elements can be driven at a 180° phase difference, a circularly polarized wave can be radiated.

The antenna device according to the present invention is preferably provided with the following structures (a)–(d):

(a) a dielectric tube, (b) a conductor provided on an inner surface of the dielectric tube and having at least two slots, (c) at least two strip conductors provided on an outer surface of the dielectric tube and crossing the slots in the opposite direction thereof, and (d) at least two helical antenna radiation elements provided on symmetrical portions of a column inserted in the which are portion of an inner space of the dielectric tube which is opposed to the slots, and which are adapted to be driven by the slots and strip conductors at a 180° phase difference.

Since an electric current can be supplied to the helical antenna in a non-contacting manner, the antenna can be moved easily.

Since the two helical antenna radiation elements can be driven at a 180° phase difference, a circularly polarized wave can be radiated.

Since the two strip conductors are extended so as to cross the slots in the opposite direction thereof, the two helical antenna radiation elements can be driven at a 180° phase difference even when a 180° phase converter is not provided.

The antenna device according to the present invention preferably has the following structures (a)–(e):

(a) a dielectric tube, (b) a conductor provided on an inner surface of the dielectric tube and having at least four slots, (c) at least four strip conductors provided on an outer surface of the dielectric tube and crossing the slots, (d) a phase difference distributing circuit adapted to give a 90° phase difference between adjacent strip conductors, and (e) at least four helical antenna radiation elements which are provided on symmetrical portions of a column inserted in an inner space of the dielectric tube which is opposed to the slots, and which are adapted to be driven by the slots and strip conductors with 90° phase differences given thereamong.

Since an electric current can be supplied to the helical antenna, the antenna can be moved easily.

Since the four helical antenna radiation elements are driven with 90° phase differences given thereamong, a circularly polarized wave can be radiated toward an upper half surface.

The antenna according to the present invention preferably has the following structures (a)–(e):

(a) a dielectric tube, (b) a conductor provided on an inner surface of the dielectric tube and having at least four slots, (c) first and second strip conductors provided on an outer surface of the dielectric tube and crossing the slots in a first direction, (d) third and fourth strip conductors provided on the outer surface of the dielectric tube and crossing the slots in a direction opposite to the first direction, and (e) a phase difference distributing circuit adapted to give a 90° phase difference between the first and second strip conductors and between the third and fourth strip conductors.

Since an electric current can be supplied to the helical antenna in a non-contacting manner, the antenna can be moved easily.

Since the four helical antenna radiation elements are driven at a 90° phase difference with respect to one another, a circularly polarized wave can be radiated.

Since the strip conductors are extended so as to cross the a slots in the opposite direction thereof with a 90° phase difference given thereto by a distributor, the four helical antenna radiation elements can be driven at a 90° phase difference even when a 180° phase converter is not provided.

DESCRIPTION OF THE PREFERRED EMBODIMENTS

The antenna device according to the present invention will now be described with reference to the drawings.

Embodiment 1

Figure 1:
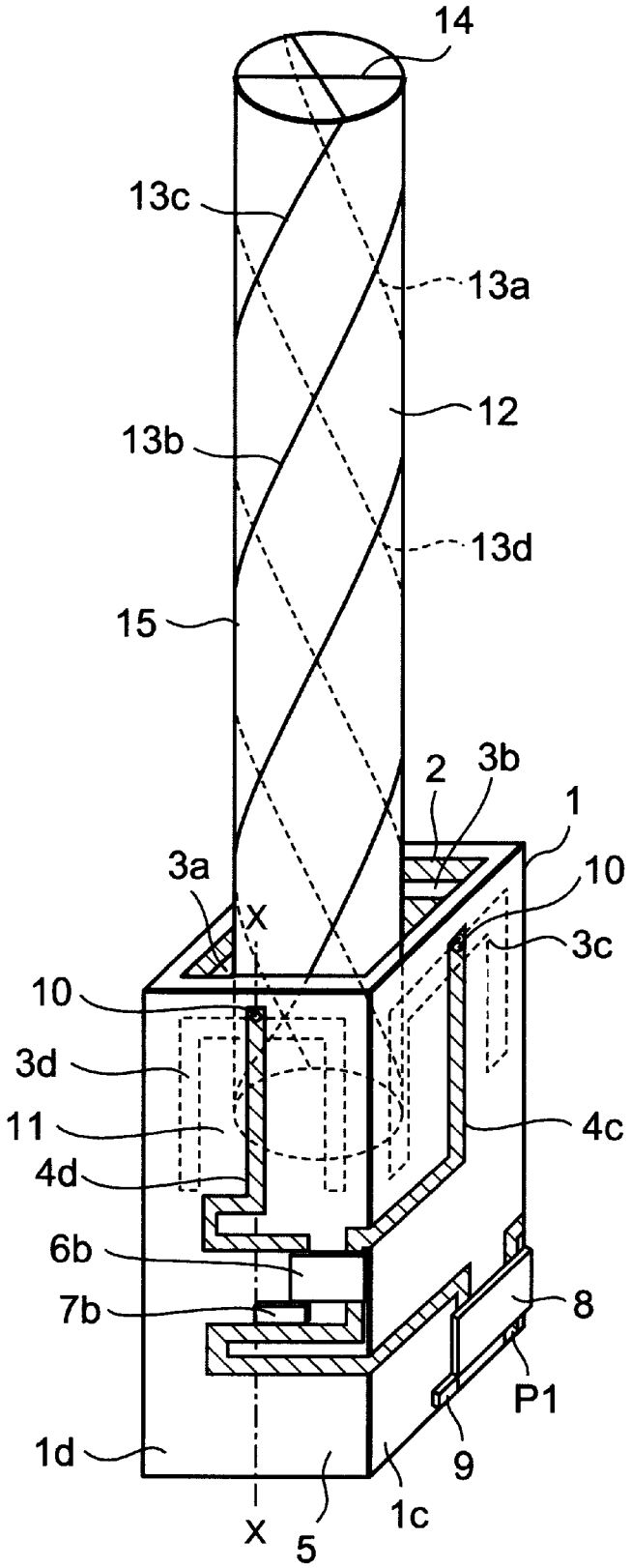
FIG. 1 is a perspective view showing a mode of embodiment of the antenna device according to the present invention.
Figure 2A:
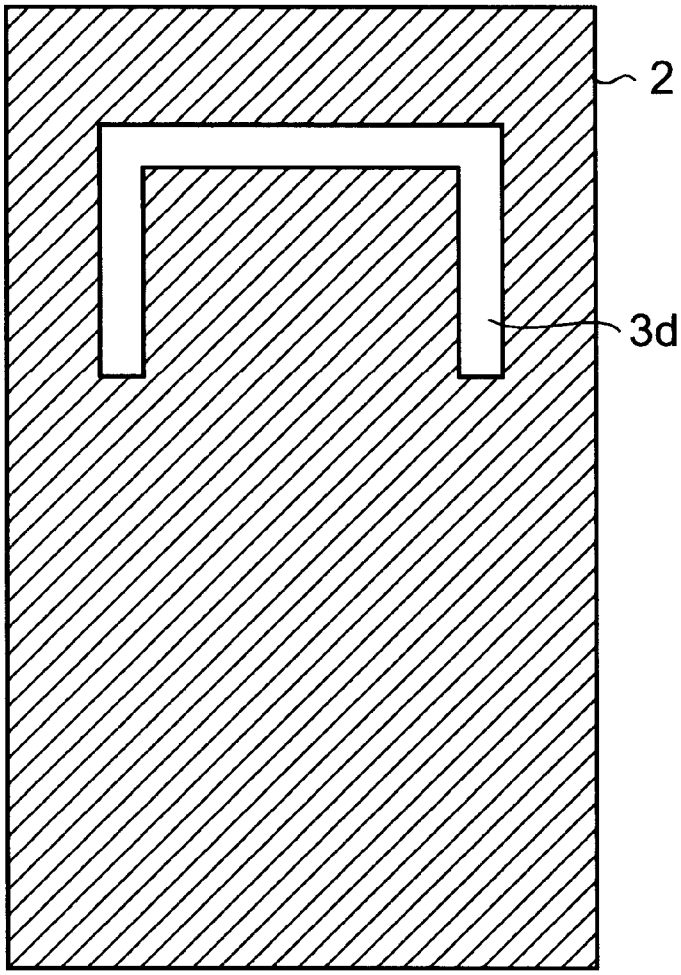
FIG. 2 is an explanatory view of a dielectric tube 1 of FIG. 1, wherein FIG. 2(*a*) is a drawing showing an inner surface, and FIG. 2(*b*) a sectional view taken along the line X—X in FIG. 1.
Figure 2B:
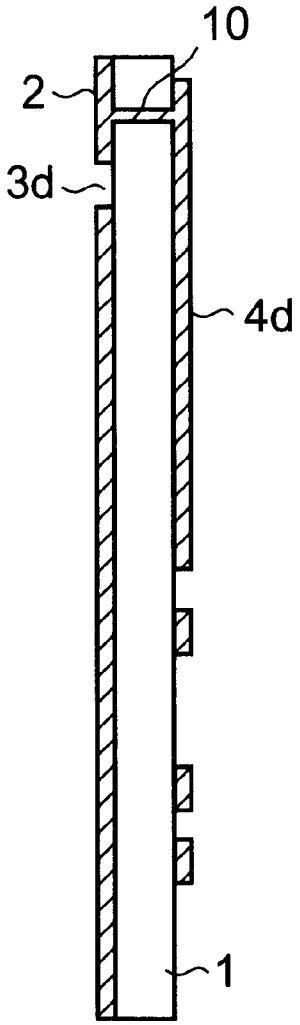
Figure 3:
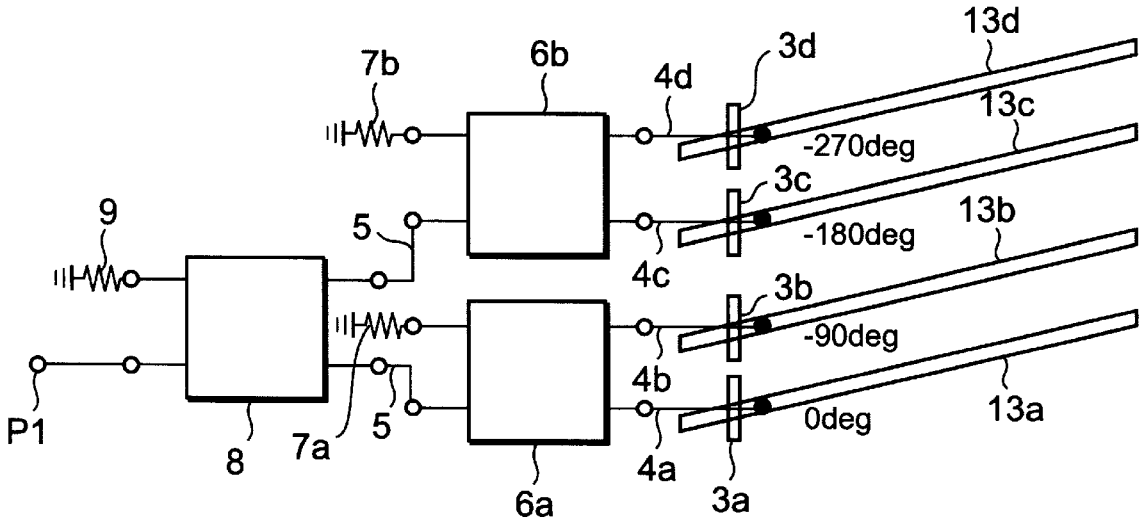
FIG. 3 is an equivalent circuit diagram of the antenna device of FIG. 1.

FIG. 1 is a perspective view showing a mode of embodiment of the antenna device according to the present invention, FIG. 2 a drawing showing an inner surface and a cross section of a dielectric tube of the antenna device of FIG. 1, and FIG. 3 an equivalent circuit diagram of the antenna device of FIG. 1.

Reference numeral 1 denotes a dielectric tube of a quadrangular cross-sectional shape, 1*c* a second outer surface, and 1*d* a first outer surface. Although a fourth outer surface hides itself behind the scene and is not seen, it is provided with a strip conductor 4*a* and a hybrid in a symmetrical manner with respect to the first outer surface 1*d*. A third outer surface also hides itself behind the scene and is not seen but it is provided with a strip conductor 4*b* in a symmetrical manner with respect to the second outer surface 1*c*.

A reference numeral 2 denotes a base conductor formed by bringing a conductive film into close contact with the whole inner surface of the dielectric tube. Reference numerals 3*a*, 3*b* denote slots formed by cutting out parts of the base conductor 2; 4*c*, 4*d*, 5 strip conductors formed by bringing conductive films into close contact with the outer surface of the dielectric tube 1; 6*a*, 6*b* 90° hybrid; and 7*a*, 7*b* resistors connected to the hybrid 6*a*, 6*b*. A reference numeral 8 denotes a 180° hybrid IC; 9 a resistor connected to the 180° hybrid IC; 10 through holes made through a wall of the dielectric tube 1; 11 a micro-strip line type feeder circuit comprising the dielectric tube 1, base conductor 2, four slots 3*a*–3*d*, four strip conductors 4*a*–4*d*, 5, 90° hybrid 6*a*, 6*b*, resistors 7*a*, 7*b*, 180° hybrid 8, resistor 9 and through holes 10; and 12 a dielectric column. Reference numerals 13*a*–13*d* denote helical antenna radiation elements formed by bringing conductive films into close contact with a surface of the dielectric column 12; 14 a short-circuited portion; and 15 a four-wire wound helical antenna comprising the dielectric column 12, helical antenna radiation elements 13*a*–13*d* and short-circuited portion 14. A reference letter P1 denotes an input/output terminal. The four strip conductors 4*a*–4*d* are connected at one end each thereof to the base conductor 2 via the through holes 10 and short-circuited, and extended at the sections thereof which are in the vicinity of these short-circuited portions in parallel with the axis of the dielectric tube 1. The four slots 3*a*–3*d* are arranged so as to cross the four strip conductors 4*a*–4*d* in positions near the through holes 10 with a distance, which corresponds to a wall thickness of the dielectric tube 1, left between upper edges of the slots and corresponding portions of an upper edge of the dielectric tube, each of the slots 3*a*–3*d* being bent at both end portions thereof and generally formed in the shape of the letter "U". The helical antenna radiation elements 13a–13d are arranged on the portions of the dielectric column 12 which are spaced from one another at 90° regular intervals around the axis thereof, and one end each of the projector elements are connected together at the short-circuited portion 14. The helical antenna radiation elements 13a–13d are arranged so as to be opposed to the four strip conductors 4a–4d via the four slots 3a–3d.

FIG. 2(a) shows the U-shaped slot 3d provided on the first inner surface which is on the opposite side of the first outer surface 1d of the dielectric tube 1. Similar slots 3c–3d are formed on the other inner surfaces as well.

FIG. 2(b) is a sectional view taken along the line X—X drawn on the dielectric tube 1 of FIG. 1. The strip conductor 4d crosses the slot 3d via the wall of the dielectric tube 1, and connected to the base conductor 2 via the through hole 10.

The coupling of the slots and micro-strip line occurs owing to the combination of longitudinal magnetic fields of slot lines with that in a cross section of the micro-strip line. The longitudinal magnetic fields of the slot lines become maximum at central portions of the slots, and the magnetic field in a cross section of the micro-strip line in a portion in the vicinity of the short-circuited portion. Accordingly, when these lines are crossed in such portions, close coupling is obtained.

The slots are the parts acting as intermediaries for the electromagnetic coupling of a feeder line and antenna radiation elements. When the slots have a ½ wavelength, they resonate to once accumulate electromagnetic energy, then re-radiate the same, and thereby aid the coupling of the feeder line and antenna radiation elements. When the slots have a wavelength other than ½ wavelength, they aid impedance matching as a susceptance elements.

The magnetic line of force surrounds both the strip conductors 4a–4d and helical antenna radiation elements 13a–13d via the slots 3a–3d to contribute to the coupling of magnetic fields.

The reason for forming the slots in the shape of the letter "U" resides in the purpose of reducing the areas thereof. They may be formed to some other shape, such as a linear shape. The positions in which the strip conductors 4a–4d and helical antenna radiation elements 13a–13d are opposed to each other are preferably near the centers of the slots.

The slots 3a–3d function as slot antennas, and are electromagnetically coupled with the helical antenna radiation elements in a non-contacting manner.

The principle of the operation of this antenna device will now be described. When an electric wave is inputted into the input/output terminal P1, it is first divided into two in the 180° hybrid 8, and the two divisional electric waves are propagated through the strip conductors 5, 5 and further divided into in the hybrid 6a, 6b, the resultant electric waves reaching the helical antenna radiation elements 13a–13d via the four strip conductors 4a–4d and four slots 3a–3d.

When the electric lengths of the strip conductors 4a–4d, 5 provided between the input/output terminal P1 and slots 3a–3d are set equal at this time, the electric wave is driven so that the phases of the helical antenna radiation elements 13a, 13b, 13c, 13d are delayed in the mentioned order by 90° by the operations of the 90° hybrid ICs 6a, 6b and 180° hybrid 8. When the length of the helical antenna radiation elements 13a–13d is set to a substantially ¼ wavelength, the electric wave driven thereby is radiated as a circularly polarized electric wave into the space. Accordingly, the helical antenna 15 is operated as a four-wire wound helical antenna radiating a circularly polarized wave.

A non-contacting feeding route extends from the strip conductors 4a–4d to the helical antenna radiation elements 13a–13d via the slots 3a–3d. The through holes 10 are provided so as to increase the electromagnetic field energy in the sections in the vicinity of the coupled portions.

The two pairs of opposed antenna radiation elements 13a, 13c; 13b, 13d are driven at a 180° phase difference.

The opposed antenna radiation elements form two parallel lines, between which an electric field has to occur. In order to positively drive this electric field, the antenna radiation elements are driven at a 180° phase difference.

A regular helical antenna comprises one element, which requires to have a length as large as n-times that of the circumference of the cylindrical surface for the purpose of radiating a beautiful circularly polarized wave. When the four helical antenna radiation elements are driven at 90° phase differences as in the above embodiment, a beautiful circularly polarized wave is radiated even though the length of the radiation elements is small.

A rat race type hybrid is used as the 180° hybrid 8, and branch line couplers or coupling line type hybrid as the 90° hybrid 6a, 6b.

Instead of the 180° hybrid IC 8, a strip conductor of a 180° electric length can be used.

A line for feeding an electric current to the antenna will now be described with reference to the equivalent circuit of FIG. 3.

An electromagnetic wave from the input/output terminal P1 is divided in the 180° hybrid 8 into two parts of a 180° phase difference, which are distributed to the two strip conductors 5, 5, in which the divisional electromagnetic waves are given 90° phase differences by the 90° hybrid 6a, 6b, the resultant divisional electromagnetic waves being distributed to the four strip conductors 4a–4d. The strip conductors 4a–4d cross the slots 3a–3d, and are electromagnetically connected thereto. The slots 3a–3d are electromagnetically connected to the helical antenna radiation elements 13a–13d in a non-contacting manner. The adjacent helical antenna radiation elements 13a–13d are driven at 90° phase differences to radiate a circularly polarized wave.

FIG. 1 shows the helical antenna 15 in a drawn-out condition.

Figure 4:
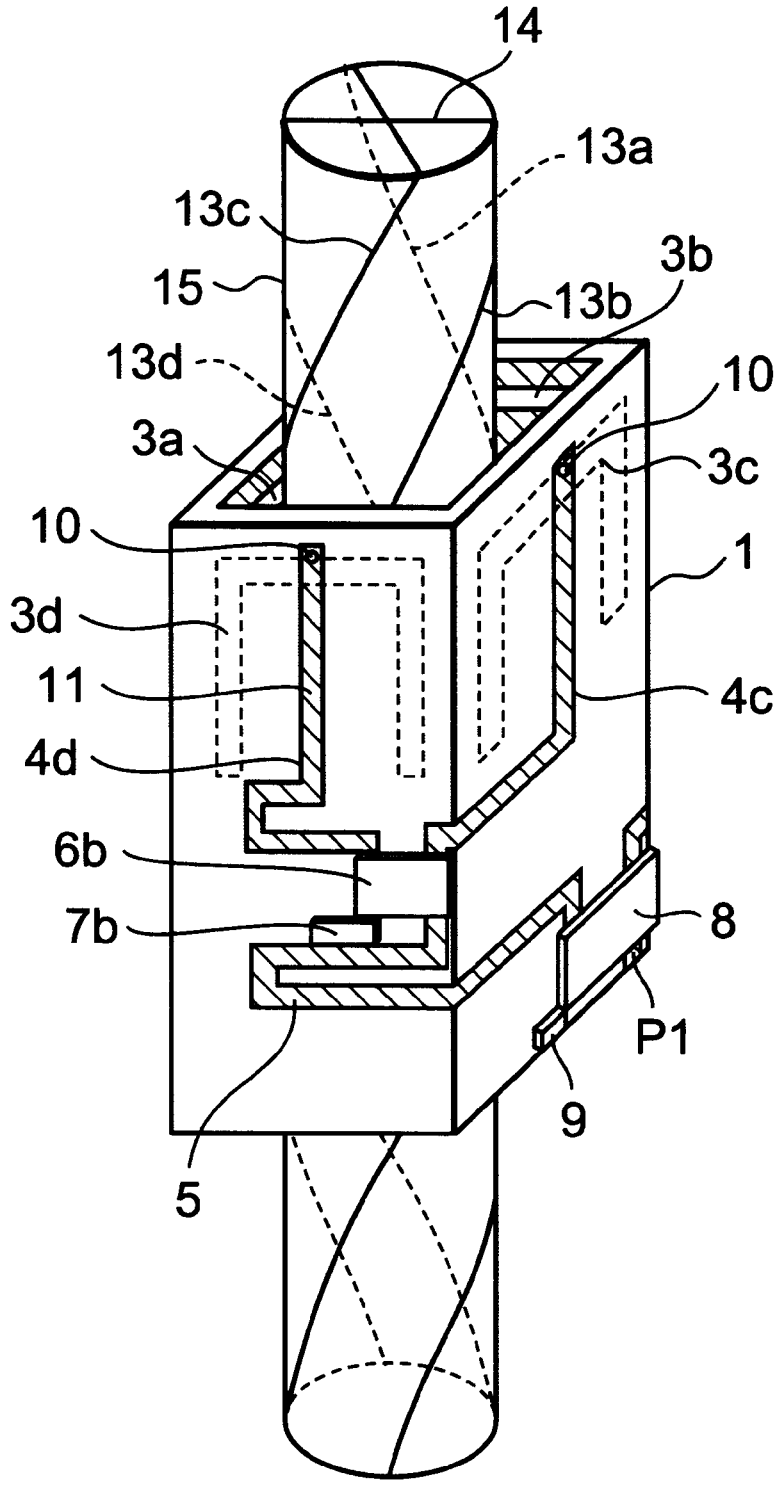
FIG. 4 is a perspective view showing a helical antenna 15 inserted through the dielectric tube 1 in the antenna device of FIG. 1.

FIG. 4 shows the helical antenna 15 inserted into the portion of the inner space of the dielectric tube 1 which is opposed to the slots on the inner surface thereof.

The characteristics of a means for extending/retracting the helical antenna element depend much on a portion of the antenna device to which the means is fixed, and innumerable portions selected for this purpose are conceivable. Since specifying the portion to which this means is fixed is difficult, it will be omitted.

The number of the helical antenna radiation element provided may be one. In such a case, the radiation element radiates an electromagnetic wave in the same manner as one regular dipole antenna (used for a portable telephone). The feeding member of this antenna may be formed by using only one surface of the dielectric tube.

The dielectric tube 1 may also be formed cylindrically.

Since the antenna device shown in FIG. 1 is formed as described above, the helical antenna 15 can be inserted in the dielectric tube 1 as shown in FIGS. 1 and 4, and extended and retracted therefrom and thereinto in a non-contacting manner, i.e., the helical antenna can be rendered movable easily.

Embodiment 2

Figure 5A:
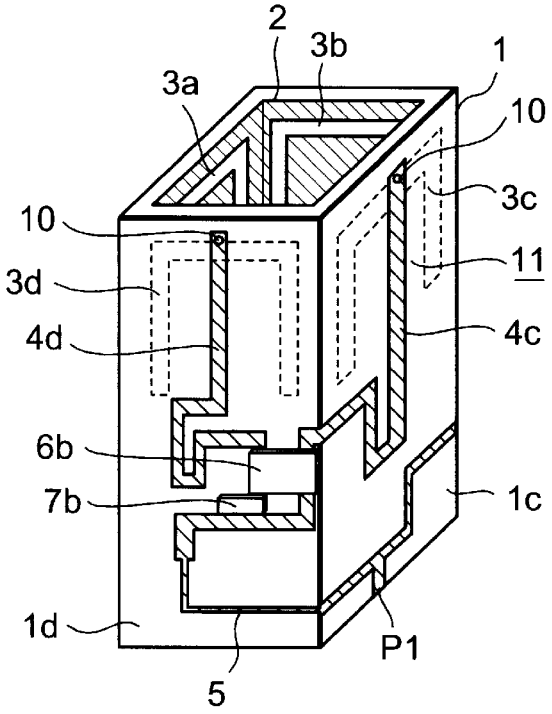
FIG. 5 is a perspective view showing another mode of embodiment of the antenna device according to the present invention, wherein FIG. 5(*a*) shows first and second surfaces, and FIG. 5(*b*) third and fourth surfaces.
Figure 5B:
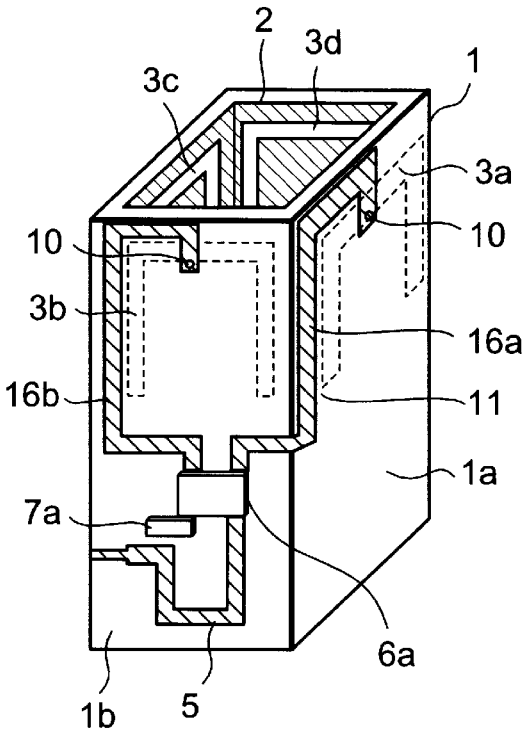
Figure 6:
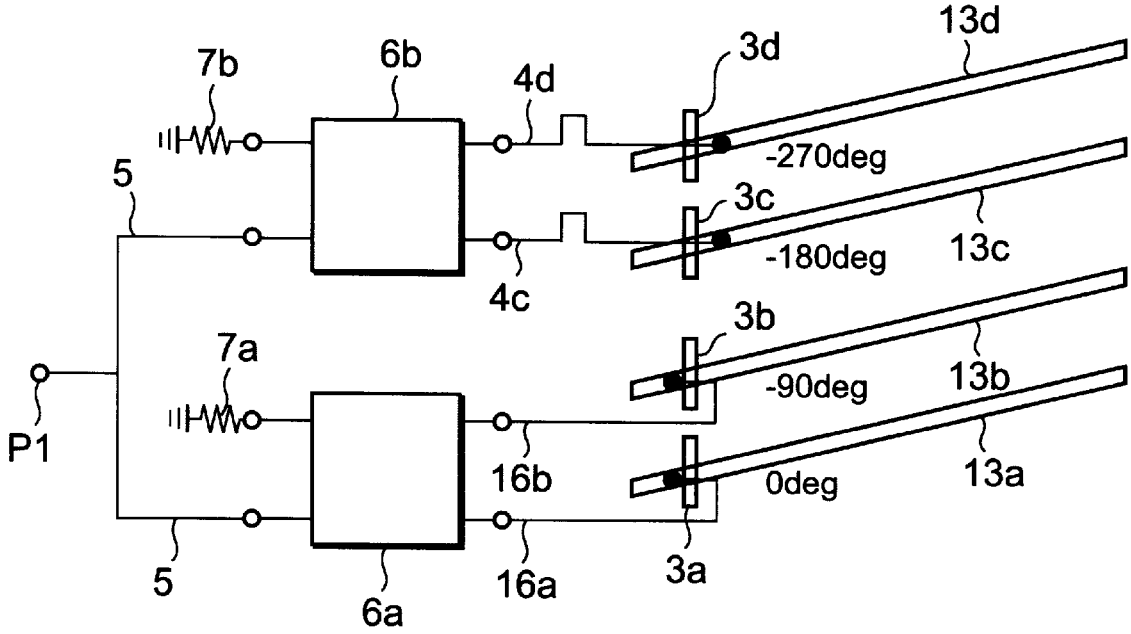
FIG. 6 is an equivalent circuit diagram of the antenna device of FIG. 5.

FIG. 5 is a perspective view showing a mode of embodiment 2 of the antenna device according to the present invention, in which a micro-strip line type feeder circuit excluding a helical antenna 15 is illustrated, FIG. 5(a) a drawing showing first and second surfaces 1*d*, 1*c*, FIG. 5(*b*) a drawing showing third and fourth surfaces 1*b*, 1*a*, and FIG. 6 is a drawing showing an equivalent circuit of the mode of embodiment 2 including the helical antenna 15.

Referring to the drawings, 1–11 and P1 denote the same parts as those in FIG. 1, and 16*a*, 16*b* strip conductors bent at short-circuited end portions thereof in the shape of the letter "U". Since the strip conductors 16*a*, 16*b* are bent at the end portions thereof in the shape of the letter "U", they are connected to a base conductor 2 on the side of an input/output terminal via through holes 10 and slots 3*a*, 3*b* and short-circuited. On the other hand, the strip conductors 4*c*, 4*d* are connected to the base conductor 2 on the opposite side of the input/output terminal via the through holes 10 and slots 3*c*, 3*d* and short-circuited. Accordingly, electric waves of opposite phases are driven by the slots 3*a*, 3*b* and slots 3*c*, 3*d*.

An electric current flowing in the strip conductors 16*a*, 16*b* crosses the slots 3*a*, 3*b* from the upper side to the lower side thereof, and that flowing in the strip conductors 4*c*, 4*d* crosses the slots 3*c*, 3*d* from the lower side to the upper side thereof. Accordingly, the directions in which the electromagnetic fields are driven by the slots also become contrary to each other. Namely, the electromagnetic fields are driven in opposite phases by the slots.

Since the embodiment of mode 2 shown in FIG. 5 is formed as described above, it has the same operation and advantages as the embodiment of mode 1, and also an advantage of dispensing with the 180° hybrid.

FIG. 6 is an equivalent circuit diagram of the embodiment of FIG. 5.

A microwave from the input/output terminal P1 is distributed in the same phase to the two strip conductors 5, 5. The resultant microwaves are distributed with 90° phase differences given thereto in 90° hybrid 6*a*, 6*b* to the four strip conductors 4*c*, 4*d*, 16*a*, 16*b*.

Since the direction in which the strip conductors 16*a*, 16*b* cross the slots 3*a*, 3*b* is contrary to that in which the strip conductors 4*c*, 4*d* cross the slots 3*c*, 3*d*, a 180° phase difference occurs. Therefore, the micro-waves in adjacent slots 3*a*, 3*b*, 3*c*, 3*d* come to have 90° phase differences.

The helical antenna radiation elements 13*a*–13*d* are driven with 90° phase differences given therebetween.

Embodiment 3

Figure 7A:
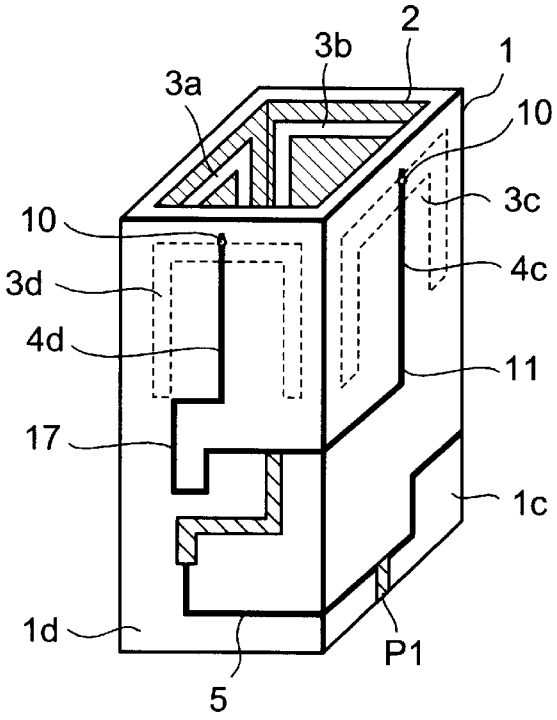
FIG. 7 is a perspective view showing still another mode of embodiment of the antenna device according to the present invention, wherein FIG. 7(*a*) shows first and second surfaces, and FIG. 7(*b*) third and fourth surfaces.
Figure 7B:
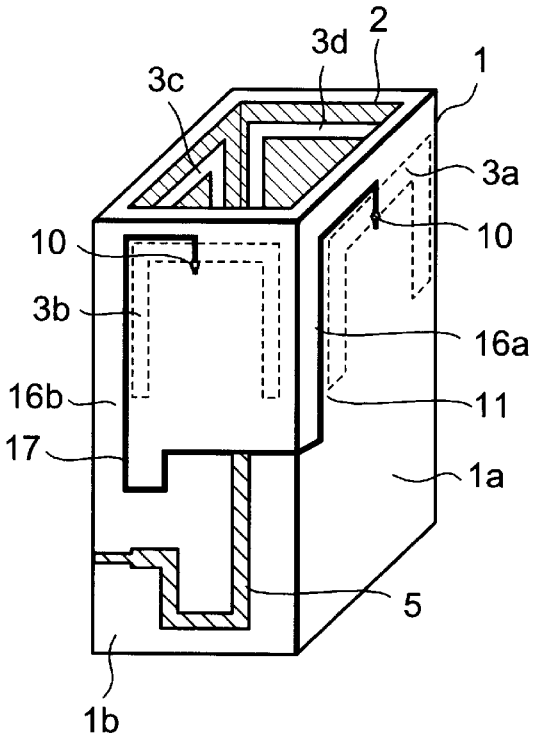
Figure 8:
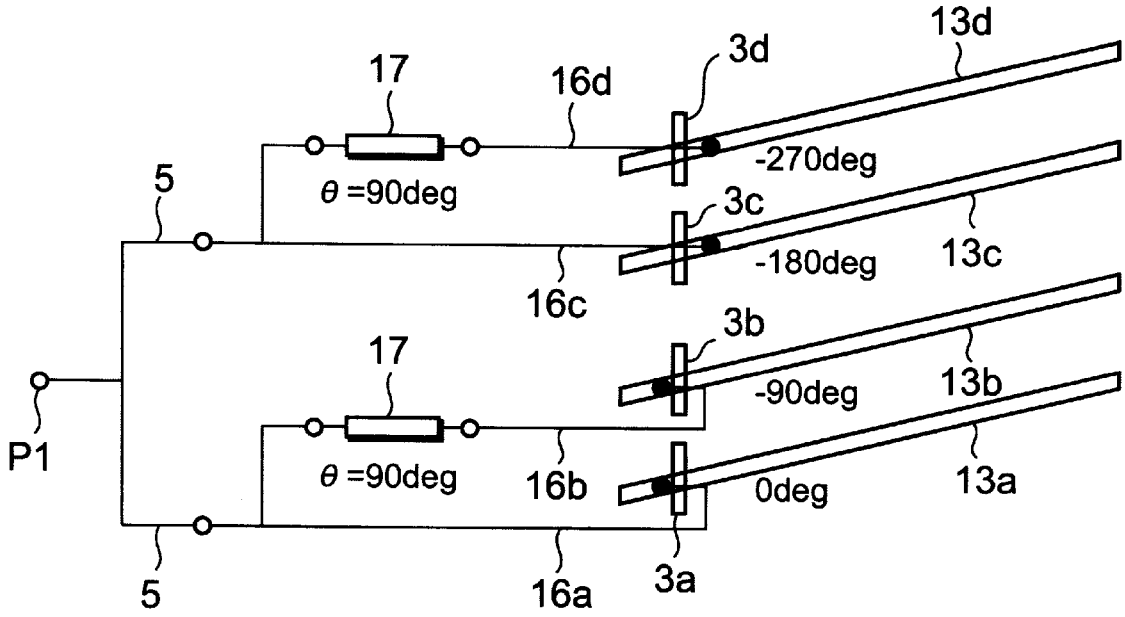
FIG. 8 is an equivalent circuit diagram of the antenna device of FIG. 7.

FIG. 7 is a perspective view showing an embodiment of mode 3 of the antenna device according to the present invention, in which a micro-strip line type feeder circuit excluding a helical antenna 15 is illustrated, FIG. 7(*a*) a drawing showing first and second surfaces 1*d*, 1*c* of a dielectric tube, FIG. 7(*b*) a drawing showing third and fourth surfaces 1*b*, 1*a* of the dielectric tube, and FIG. 8 a drawing showing an equivalent circuit of the embodiment of mode 3 including the helical antenna 15. Referring to the drawings, 1–11, 16*a*, 16*b* and P1 denote the same parts as those in FIG. 5, and 17 phase adjustment strip conductors of a 90° electric length.

This mode of embodiment uses the phase adjustment strip conductors of a 90° electric length instead of the hybrid 6*a*, 6*b* of FIGS. 5 and 6. The remaining portions of this embodiment have the same structures as the corresponding portions of the embodiment of FIGS. 5 and 6.

The embodiment of mode 3 will now be described with reference to the equivalent circuit diagram of FIG. 8.

A microwave from an input/output terminal P1 is distributed in the same phase to two strip conductors 5, 5. The resultant microwaves are given a 90° phase difference in strip conductors 17, 17 of a 90° electric length, and distributed to strip conductors 16*a*–16*d*. Since the direction in which the strip conductors 16*a*, 16*b* cross slots 3*a*, 3*b* is contrary to that in which the strip conductors 16*c*, 16*d* cross slots 3*c*, 3*d*, the microwaves in the slots 3*a*, 3*b* come to have a 180° phase difference with respect to those in the slots 3*c*, 3*d*.

Accordingly, adjacent helical antenna radiation elements 13*a*–13*d* are driven with 90° phase differences given thereto.

Since the embodiment of mode 3 shown in FIGS. 7 and 8 is formed as described above, it has the same operation and advantages as the embodiment of mode 2, and also the advantages of a capability of rendering the 90° hybrid 6*a*, 6*b* unnecessary and forming the feeder circuit of micro-strip line alone.

Embodiment 4

Figure 9A:
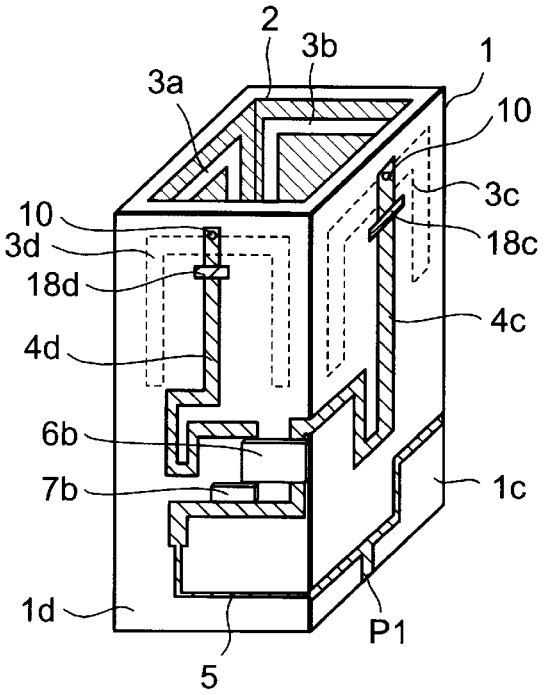
FIG. 9 is a perspective view showing a further mode of embodiment of the antenna device according to the present invention, wherein FIG. 9(*a*) shows first and second surfaces, and FIG. 9(*b*) third and fourth surfaces.
Figure 9B:
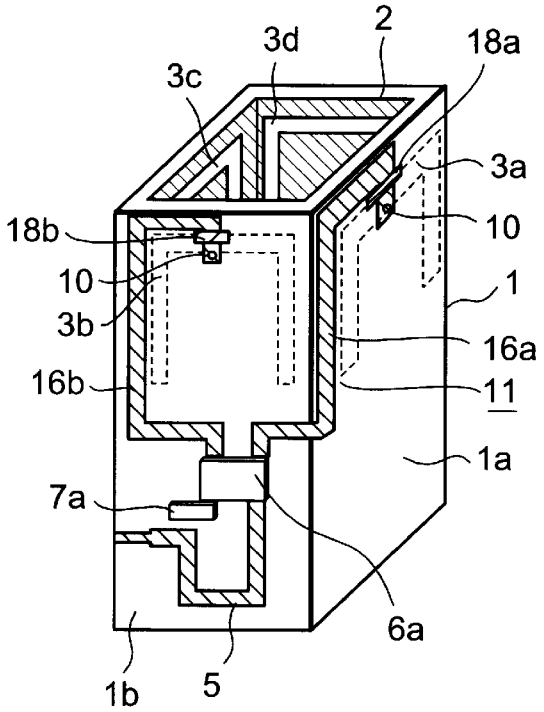
Figure 10:
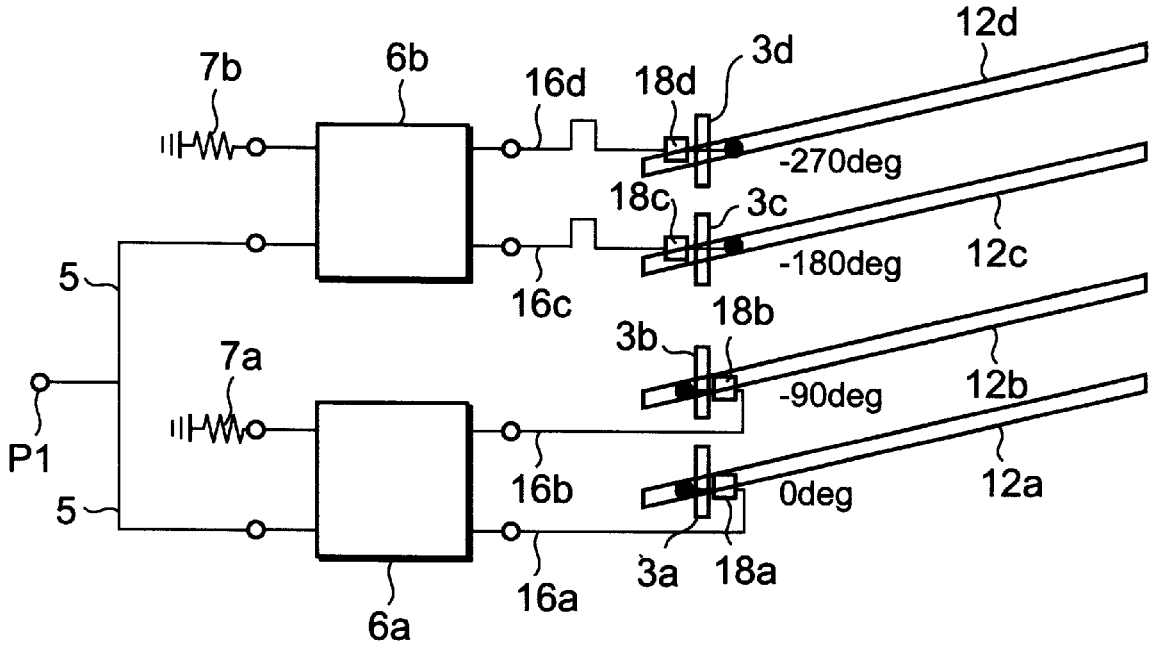
FIG. 10 is an equivalent circuit diagram of the antenna device of FIG. 9.

FIG. 9 is a schematic construction diagram showing an embodiment of mode 4 of the antenna device according to the present invention, in which a micro-strip line type feeder circuit excluding a helical antenna 15 is illustrated, FIG. 9(*a*) a drawing showing first and second surfaces 1*d*, 1*c* of a dielectric tube 1, FIG. 9(*b*) a drawing showing third and fourth surfaces 1*b*, 1*a* of the dielectric tube 1, and FIG. 10 is a drawing showing an equivalent circuit of the embodiment of mode 4 including the helical antenna 15. Referring to the drawings, 1–11, 16*a*, 16*b*, P1 denote the same parts as those in FIG. 5, and 18*a*–18*d* chip capacitors for obtaining a matched impedance of helical antenna radiation elements 13*a*–13*d*. A matched impedance of the helical antenna radiation elements 13*a*–13*d* is obtained by regulating mainly the relative positions of the helical antenna radiation elements 13*a*–13*d* and slots 3*a*–3*d*, the distances between the short-circuited ends (through holes 10) of strip conductors 4*c*, 4*d*, 16*a*, 16*b* and the slots 3*a*–3*d*, and the lengths of the slots 3*a*–3*d*. When the chip capacitors 18*a*–18*d* are added, the degree of freedom of obtaining the matched impedance increases.

When a capacity value of the chip capacitors is varied, the range of the shape of the antenna radiation elements capable of obtaining a matched impedance widens.

The chip capacitors 18*a*–18*d* are inserted in series in gaps of the strip conductors 4*c*, 4*d*, 16*a*, 16*b*.

This mode of embodiment is formed by providing the chip capacitors 18*a*–18*d* on the strip conductors 16*a*, 16*b*, 4*c*, 4*d* of the embodiment (of mode 2) of FIGS. 5 and 6, and the construction of the remaining portions is identical with the corresponding portions of the embodiment of FIGS. 5 and 6.

A non-contacting feeding operation in the embodiment of mode 4 will now be described with reference to an equivalent circuit of FIG. 10.

A microwave from the input/output terminal P1 is distributed in the same phase to two strip conductors 5, 5. The resultant microwaves are given 90° phase differences in 90° hybrid 6*a*, 6*b*, and distributed to the four strip conductors 16*a*, 16*b*, 4*c*, 4*d*.

The direction in which the strip conductors 16*a*, 16*b* cross the slots 3*a*, 3*b* is contrary to that in which the strip conductors 4*c*, 4*d* cross the slots 3*c*, 3*d*, so that a 180° phase difference occurs.

90° phase differences occur in the microwaves in adjacent slots 3*a*–3*d*. Accordingly, the helical antenna radiation elements 13*a*–13*d* are driven with 90° phase differences given between adjacent radiation elements.

Instead of the chip capacitors, comb-shaped interdigited capacitors formed of strip conductor patterns may be used.

A ¼ wavelength transformer, an end-opened stub as a parallel capacity, and an end-short-circuited stub or a chip coil as a parallel inductance can also be used as the matching circuit.

The ¼ wavelength transformer has a function of connecting two lines of different impedances together without causing reflection to occur. When the line length is set to ¼ wavelength, reflections due to the discontinuity of line widths at both ends of the ¼ wavelength lines offset each other (due to the reciprocation of the reflections, the line length becomes ½ wavelength, and the phase is reversed). Therefore, when the amplitude of reflection at the discontinuing ends is set equal by regulating the line width, the overall reflection becomes zero.

In an end-opened transmission line of not more than ¼ wavelength or of not more than ¼ wavelength plus n/2 wavelength, the input impedance with respect to an end portion on the opposite side of the opened end becomes parallel capacitive. Such a transmission line is an end-opened stub. In an end-opened transmission line of not more than ¼ wavelength or of not more than ¼ wavelength plus n/2 wavelength, the input impedance with respect to an end portion on the opposite side of the short-circuited end becomes parallel inductive. Such a transmission line is an end-short-circuited stub.

The reasons for providing the matching circuit reside in the purpose of widening the frequency range which permits matched impedance to be obtained and reflection to be minimized, further improving the reflection characteristics, or reducing the rate of deterioration, which is ascribed to dimensional errors, of the reflection characteristics.

The matching circuits are preferably provided on the portions of the strip conductors which are in the vicinity of the slots.

The embodiment of mode 4 shown in FIGS. 9 and 10 is formed as described above. Therefore, it has the same operation and advantages as the embodiment of mode 2, and also an advantage of the capability of widening the range of conditions for obtaining matched impedance.

Embodiment 5

Although the end portions of the strip conductors 4*a*–4*c* in the embodiments of modes 1–4 are short-circuited to the base conductor 2 via the through holes 10, they can also be opened.

Figure 11:
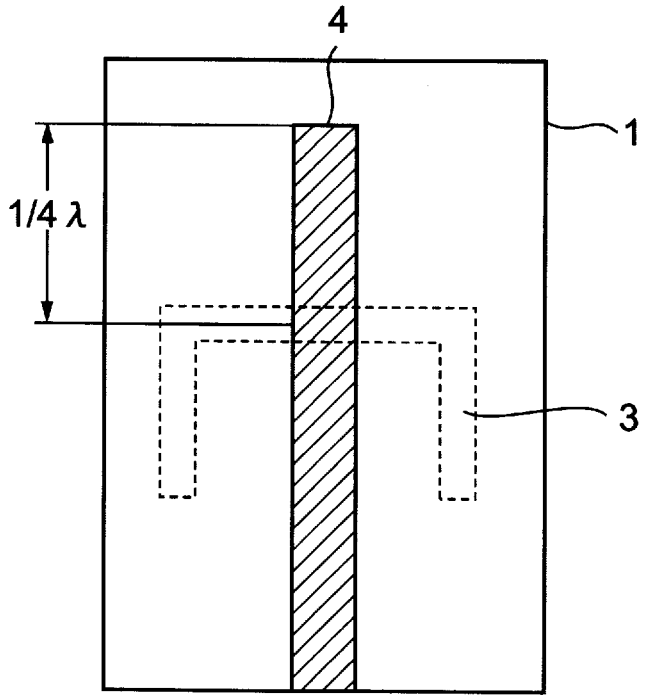
FIG. 11 is a drawing showing another mode of example of a strip conductor of the antenna device according to the present invention.

FIG. 11 is a drawing showing an upper portion only of one surface of a dielectric tube of the embodiment of mode 5 of the antenna device according to the present invention.

The strip conductor 4 provided on the dielectric tube 1 crosses a slot 3 via the wall of the dielectric tube 1, and extends upward from a point of intersection by ¼ wavelength to terminate at an opened end. The dielectric tube 1 is not provided with through holes.

The slots 3*a*–3*d* and upper portions of the strip conductors 4*a*–4*d* of FIG. 1 can be replaced by the slot 3 and strip conductor 4 of FIG. 11, and such slot 3 and strip conductor 4 function in the same manner as those of FIG. 1. An equivalent circuit of this structure is identical with that shown in FIG. 3.

Embodiment 6

In the end-opened strip conductors, a 180° phase difference can also be given thereto by reversing the direction in which the strip conductors cross the slots. This enables 180° hybrid to be omitted.

Figure 12:
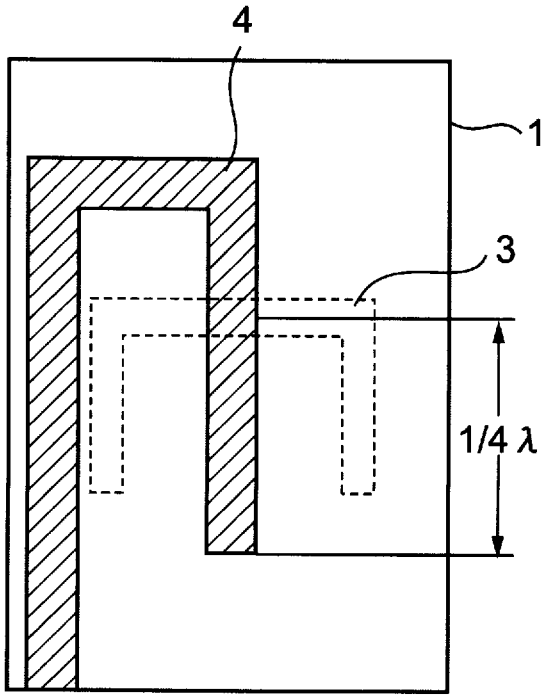
FIG. 12 is a drawing showing still another mode of example of the strip conductor of the antenna device according to the present invention.
Figure 13:
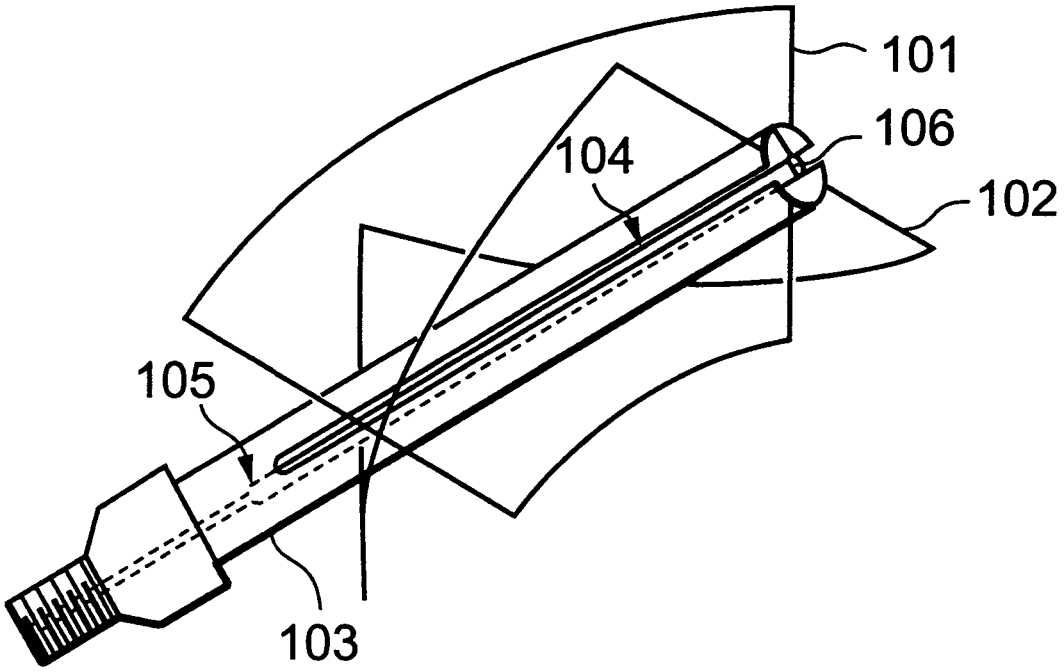
FIG. 13 (PRIOR ART)
FIG. 13 is a drawing showing an example of a conventional antenna device.

FIG. 12 is a drawing showing an upper portion only of one surface of a dielectric tube of an embodiment of mode 6 of the antenna device according to the present invention.

An end portion of a strip conductor 4 is bent in the shape of the letter "U", and crosses a slot 3 via the wall of the dielectric tube in the direction opposite to the direction shown in FIG. 11. The strip conductor 4 extends from a point of intersection with respect to the slot 3 by ¼ wavelength, and terminates in an opened state. Consequently, the microwave in the slot 3 of FIG. 12 has a 180° phase difference with respect to that in the slot 3 of FIG. 11.

The upper portions of the strip conductors 4*d*, 4*c* on the first and second surfaces 1*d*, 1*c* of the dielectric tube of FIG. 5(*a*) and slots 3*d*, 3*c* can be replaced by the strip conductor 4 and slot 3 of FIG. 11, and the upper portions of the strip conductors 1*b*, 1*a* on the third and fourth surfaces 1*b*, 1*a* and slots 3*b*, 3*a* by the strip conductor 4 and slot 3 of FIG. 12. In such a case, the antenna device functions in the same manner as that of FIG. 5, and the equivalent circuit thereof becomes identical with that of FIG. 6.

What is claimed is:

1. An antenna device comprising the following structures (a)–(d):

(a) a dielectric tube having an inner surface and an outer surface, (b) a conductor provided on said inner surface of said dielectric tube and having at least two slots provided therein, (c) at least two strip conductors provided on said outer surface of said dielectric tube and crossing said slots in opposite directions, and (d) at least two helical antenna radiation elements which are provided on symmetrical portions of a column inserted in an inner space of said dielectric tube at positions opposite to said slots, said radiation elements being adapted to be driven at a 180° phase difference by said strip conductors through said slots.

2. An antenna device comprising the following structures (a)–(e):

(a) a dielectric tube having an inner surface and an outer surface, (b) a conductor provided on said inner surface of said dielectric tube and having at least two slots provided therein, (c) at least two strip conductors provided on said outer surface of said dielectric tube and crossing said slots, (d) a phase difference distributing circuit adapted to give a 180° phase difference between electromagnetic waves propagated through said strip conductors, and (e) at least two helical antenna radiation elements which are provided on symmetrical portions of a column inserted in an inner space of said dielectric tube at positions opposite to said slots, said radiation elements being adapted to be driven at a 180° phase difference by said strip conductors through said slots.

3. An antenna device according to claim 2, wherein said phase difference distributing circuit is a 180° hybrid.

4. An antenna device comprising the following structures (a)–(e):

(a) a dielectric tube having an inner surface and an outer surface, (b) a conductor provided on said inner surface of said dielectric tube and having at least four slots provided therein, (c) at least four strip conductors provided on said outer surface of said dielectric tube and crossing said slots, (d) a phase difference distributing circuit adapted to give a 90° phase difference between adjacent strip conductors, and (e) at least four helical antenna radiation elements which are provided on symmetrical portions of a column inserted in an inner space of said dielectric tube at positions opposite to said slots, said radiation elements being adapted to be driven with a 90° phase difference between adjacent elements by said strip conductors through said slots.

5. An antenna device according to claim 4, wherein said phase difference distributing circuit is formed of one 180° hybrid and two 90° hybrids.

6. An antenna device comprising the following structures (a)–(f):

(a) a dielectric tube having an inner surface and an outer surface, (b) a conductor provided on said inner surface of said dielectric tube and having at least four slots provided therein, (c) first and second strip conductors provided on said outer surface of said dielectric tube and crossing said slots in a first direction, (d) third and fourth strip conductors provided on said outer surface of said dielectric tube and crossing said slots in a direction opposite to the first direction, (e) a phase difference distributing circuit adapted to give a 90° phase difference between said first and second strip conductors and between said third and fourth strip conductors; and (f) a plurality of helical antenna radiation elements inserted in an inner space of said dielectric tube at positions opposite to said slots, said radiation elements being adapted to be driven by said strip conductors through said slots.

7. An antenna device according to claim 6, wherein said phase difference distributing circuit is a 90° hybrid.

8. An antenna device according to claim 6, wherein said phase difference distributing circuit is a transmission line of 90° in electric length.

9. An antenna device comprising the following structures (a)–(d):

(a) a dielectric tube having an inner surface and an outer surface, (b) a conductor provided on said inner surface of said dielectric tube and having a plurality of slots provided therein, (c) strip conductors provided on said outer surface of said dielectric tube and crossing said slots, and (d) a plurality of helical antenna radiation elements inserted in an inner space of said dielectric tube at positions opposite to said slots, said radiation elements being adapted to be driven by said strip conductors through said slots.

10. An antenna device according to claim 9, wherein said slots are formed in the shape of the letter "U".

11. An antenna device according to claim 9, wherein said strip conductors are provided with matching circuits.

12. An antenna device according to claim 11, wherein said matching circuits are capacitors.

* * * * *